US007159284B2

(12) United States Patent
Gastaldi

(10) Patent No.: US 7,159,284 B2
(45) Date of Patent: Jan. 9, 2007

(54) SEAT BELT BUCKLE, IN PARTICULAR FOR RACING VEHICLES

(75) Inventor: Roberto Gastaldi, Turin (IT)

(73) Assignee: Belt & Buckle S.r.l., Turin (IT)

( * ) Notice: Subject to any disclaimer, the term of this patent is extended or adjusted under 35 U.S.C. 154(b) by 126 days.

(21) Appl. No.: 10/935,083

(22) Filed: Sep. 8, 2004

(65) Prior Publication Data

US 2005/0086778 A1 Apr. 28, 2005

(30) Foreign Application Priority Data

Sep. 9, 2003 (IT) ..... TO2003A000683

(51) Int. Cl.
*A44B 11/25* (2006.01)

(52) U.S. Cl. ..... 24/633; 24/632

(58) Field of Classification Search ..... 24/630–653, 24/265 BC, 579.09, 579.11; 280/801.1, 280/808

See application file for complete search history.

(56) References Cited

U.S. PATENT DOCUMENTS

| | | | | |
|---|---|---|---|---|
| 3,747,167 | A | 7/1973 | Pravaz | |
| 4,742,604 | A * | 5/1988 | Mazelsky | 24/639 |
| 4,987,662 | A * | 1/1991 | Haffey et al. | 24/633 |
| 5,144,725 | A * | 9/1992 | Krauss | 24/633 |
| 5,311,649 | A * | 5/1994 | Suh | 24/635 |
| 5,419,020 | A * | 5/1995 | Murai | 24/633 |
| 5,432,987 | A * | 7/1995 | Schroth | 24/635 |
| 5,542,590 | A * | 8/1996 | Pfitzenmaier | 24/633 |
| 6,065,367 | A | 5/2000 | Schroth | |
| 6,431,652 | B1 * | 8/2002 | Kennedy | 297/464 |
| 2002/0112327 | A1 * | 8/2002 | Baloga | 24/633 |
| 2003/0098575 | A1 | 5/2003 | Schroth et al. | |
| 2004/0255439 | A1 * | 12/2004 | Benedict | 24/640 |

* cited by examiner

*Primary Examiner*—Robert J. Sandy
*Assistant Examiner*—Ruth C. Rodriguez
(74) *Attorney, Agent, or Firm*—Birch, Stewart, Kolasch, and Birch, LLP

(57) ABSTRACT

A seat belt buckle, in particular for racing vehicles, having: a casing defining at least one slot engageable by an end member of a strap of a seat belt for connection; a lock mechanism housed in the casing and for releasably retaining the end member; and a release lever fitted to the casing and movable, from a rest position, along a path lying in an actuating plane to release the lock mechanism from the end member, the release lever having an end projecting from the casing in the actuating plane as the release lever moves along the path. The buckle also has a lever guard portion fitted to the casing and having a lateral surface, an ideal extension of which in a direction perpendicular to the actuating plane surrounds the end of the release lever in the rest position.

12 Claims, 2 Drawing Sheets

SEAT BELT BUCKLE, IN PARTICULAR FOR RACING VEHICLES

This Nonprovisional application claims priority under 35 U.S.C. § 119(a) on Patent Application No(s). T02003A 000683 filed in Italy on Sep. 9, 2003, the entire contents of which are hereby incorporated by reference.

The present invention relates to a seat belt buckle, in particular for racing vehicles, to which the following description refers purely by way of example.

BACKGROUND OF THE INVENTION

As is known, regulations require that motor vehicles be equipped with seat belts fitted directly or indirectly to the vehicle body at so-called anchorage points, and for securing the driver to the driver's seat in the event of accidents.

In racing vehicles, the various straps of the seat belt are designed to immobilize the driver's shoulders, pelvis, and, possibly, legs, and are connected to one another at a single point, normally located in front of the torso and at the height of the driver's pelvis, by a common buckle enabling simultaneous locking and release of the individual straps.

More specifically, the buckle comprises a casing housing a releasable lock mechanism and defining five openings in which to insert and lock respective metal end members (tongues) fixed to the ends of the seat belt straps.

The buckle casing is also fitted with a manually operated release lever to rapidly release the lock mechanism from the tongues of all the seat belt straps, and so enable the driver, in an emergency, to free himself easily from the seat belt securing him in the driver's seat.

Current regulations require that the buckle be connected to the various tongues of the seat belt so that the release lever in the rest position faces downwards, i.e. towards the driver's feet.

The release lever of most known buckles is sized and shaped to project from the buckle casing to permit relatively easy operation by the driver.

Because of the movements of the driver when driving the vehicle, however, the release lever, given its position, may come into contact with the driver's legs, thus resulting in discomfort, and may even be inadvertently released by the driver when driving the vehicle, thus resulting in undesired release of the seat belt and exposure of the driver to grave danger in the event of an accident.

SUMMARY OF THE INVENTION

It is an object of the present invention to provide a seat belt buckle, in particular for racing vehicles, designed to eliminate the aforementioned drawbacks.

According to the present invention, there is provided a seat belt buckle, in particular for racing vehicles.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
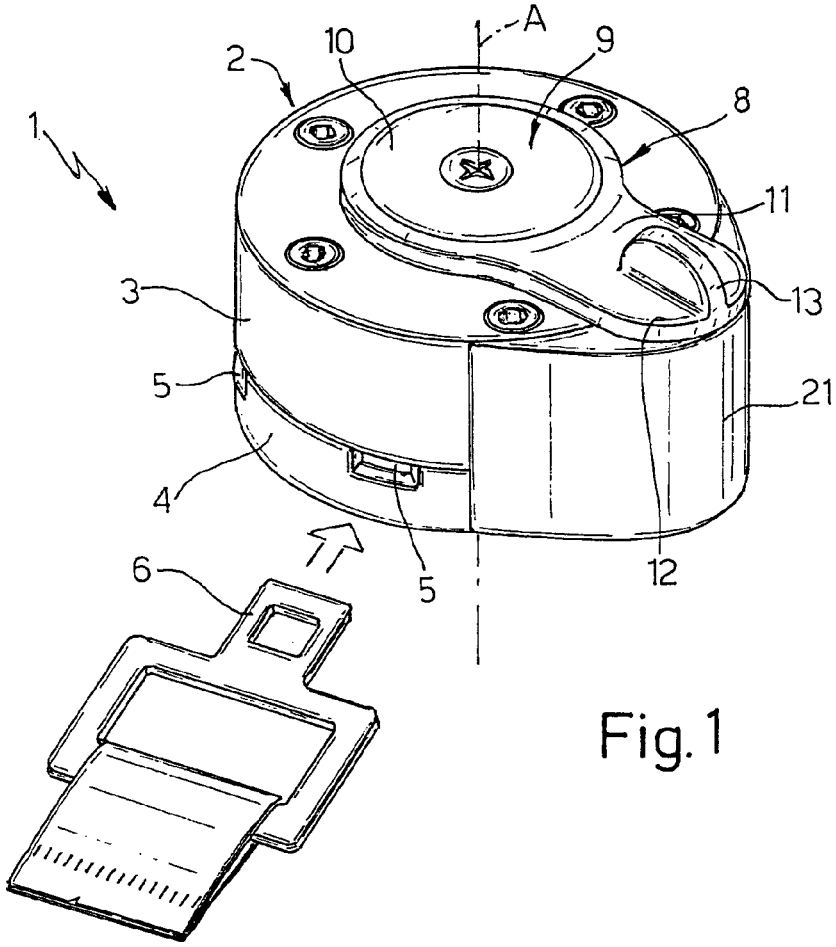
FIG. 1 shows a view, in perspective, of a preferred embodiment of the buckle according to the invention.

Number 1 in FIG. 1 indicates a seat belt buckle, in particular for racing vehicles.

Buckle 1 comprises a substantially cylindrical casing 2, of axis A, defined by a cup-shaped body 3 and a base 4 connected to each other by screws.

Casing 2 comprises a substantially cylindrical lateral surface; and an end surface perpendicular to axis A.

The lateral surface defines five slots 5 unequally spaced angularly about axis A, and which are engaged, in use, by respective end members 6 (only one shown) defined by die-cut metal parts and attached to the seat belt straps.

Casing 2 houses a known lock mechanism 7 (FIG. 5) for releasably retaining end members 6 of the seat belt.

A release lever 8, connected to lock mechanism 7, is hinged to the end surface to rotate roughly 90° about axis A, and along a path lying in an actuating plane perpendicular to axis A, from a rest position to at least one release position, so as to release lock mechanism 7 simultaneously from all the end members 6 of the seat belt straps.

Release lever 8 comprises a plate 9 lying on the end surface and defined by a circular ring 10 hinged to the end surface, and by an arm 11 integral with circular ring 10 and having an end 12 projecting radially from the lateral surface of casing 2 when release lever 8 is rotated about axis A (in a manner not shown).

Release lever 8 also comprises a grip appendix 13 projecting from end 12 of arm 11 and extending parallel to axis A, in the opposite direction to the end surface of casing 2, to permit easy grip and operation of release lever 8 by the driver.

Figure 3:
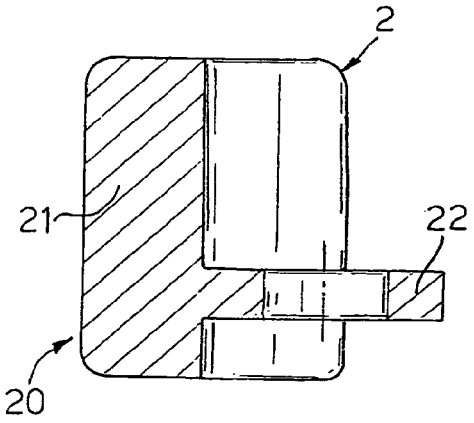
FIG. 3 shows a section taken along line III—III in FIG. 2.
Figure 2:
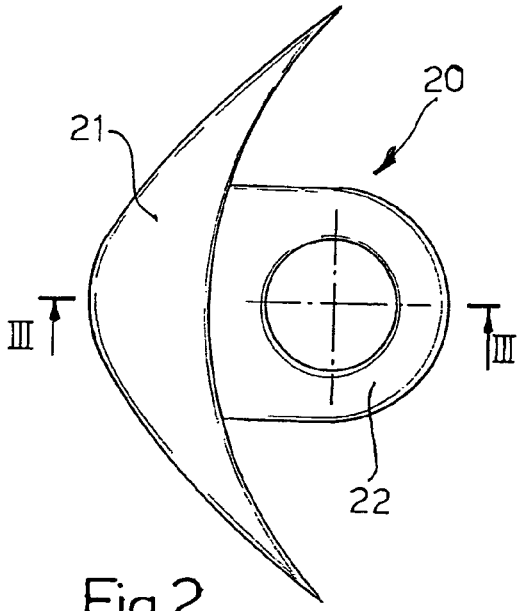
FIG. 2 shows a top plan view of a detail in FIG. 1.

According to the invention, buckle 1 also comprises an additional safety component 20, shown in detail in FIGS. 2 and 3, for preventing inadvertent operation of release lever 8 when release lever 8 is in the rest position.

With reference to FIGS. 1 to 3, additional safety component 20 comprises a lever guard portion 21, which rests on the lateral surface of casing 2 and is substantially half-moon-shaped (FIG. 2), so that, viewed along axis A, buckle 1 has a substantially ovoid lateral profile with no corners.

Lever guard portion 21 is the same thickness as casing 2 along axis A, is positioned contacting plate 9 of release lever 8 in a direction parallel to axis A, and comprises a concave surface complementary to and mating with the lateral surface of casing 2, and a curved convex outer surface blending seamlessly with the lateral surface to avoid corners.

As shown particularly in FIG. 1, an ideal extension of the curved convex outer surface of lever guard portion 21 in a direction parallel to axis A surrounds end 12 of release lever 8 when release lever 8 is in the rest position.

Figure 4:
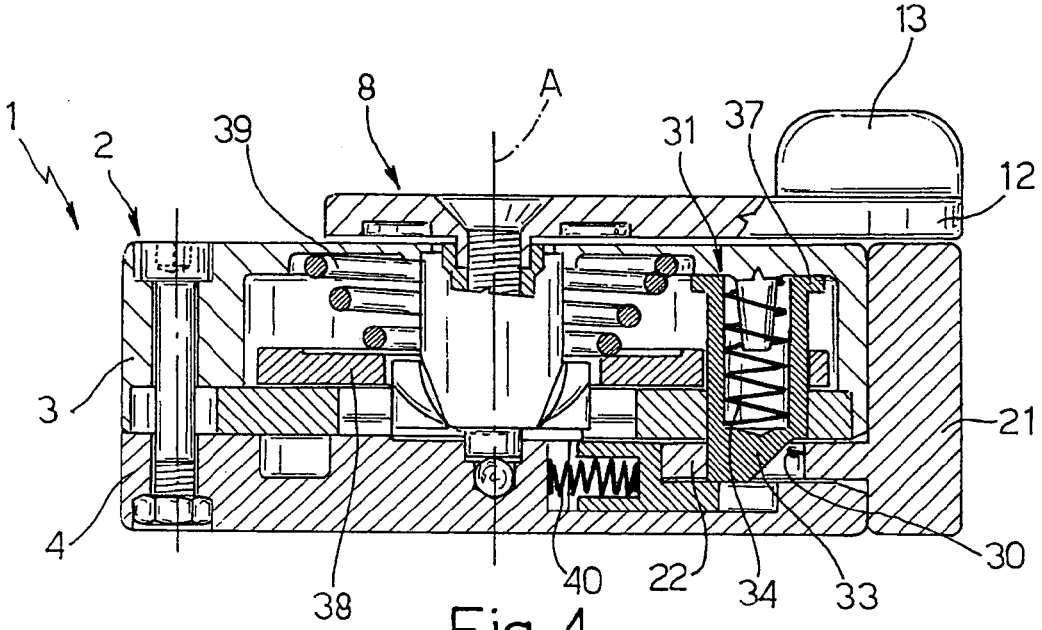
FIG. 4 shows a cross section of the FIG. 1 buckle.

Additional safety component 20 also comprises a lock appendix 22 having a hole, and which projects from the concave surface, is substantially the same shape as end members 6 of the seat belt, and engages a slot 5 defined by the lateral surface of casing 2 and indicated by reference number 30 (FIG. 4).

Figure 5:
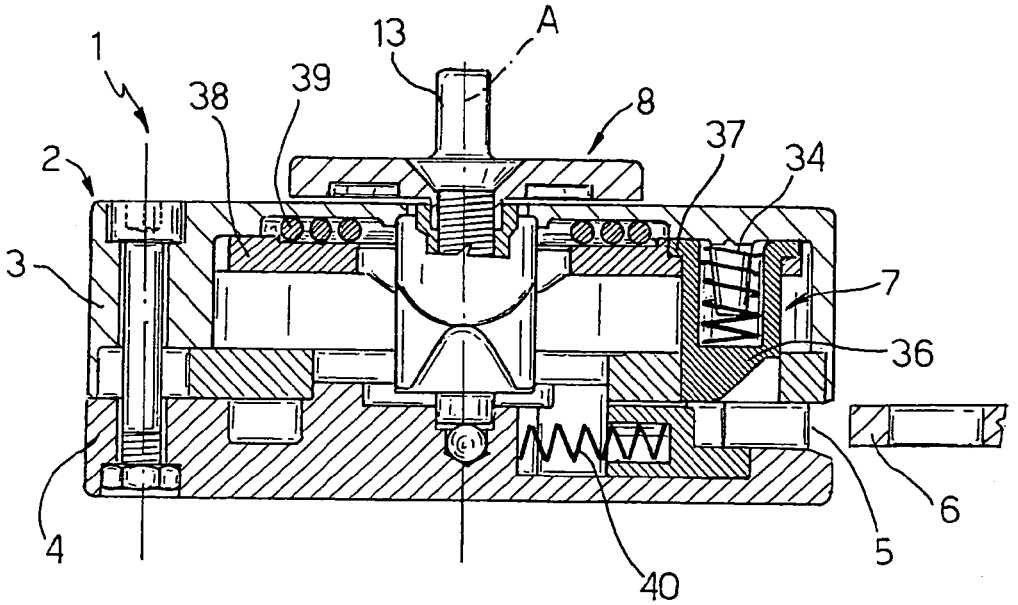
FIG. 5 is similar to FIG. 4, and shows a different section of the buckle in a different operating condition.

FIGS. 4 and 5 show cross sections of buckle 1 in two different planes and in two different operating conditions. More specifically, FIG. 4 shows engagement of lever guard portion 21 of additional safety component 20, and FIG. 5 release of an end member 6 of the seat belt.

Lock appendix 22 (FIG. 4) is retained irreversibly inside slot 30 by a lock device 31 housed in casing 2 and comprising a lock pin 33, which is pushed, in a direction parallel to axis A, into a lock position by a spring 34.

One end of lock pin 33 has an inclined surface facing the inlet of slot 30, and which backs up lock pin 33 as lock appendix 22 of additional component 22 is inserted inside slot 30. Once lock appendix 22 is inserted fully inside slot 30, lock pin 33 is pushed by spring 34 so as to click inside the hole in lock appendix 22 and so lock additional component 20 and prevent withdrawal of lock appendix 22 from slot 30.

Lock pin 33 is what is known in slang as a "dummy", in that lock device 31, of which it forms part, is distinct from lock mechanism 7 (FIG. 5) and, in use, is not subject to the release action of release lever 8, so that connection of lever guard portion 21 to casing 2 of buckle 1 is irreversible.

With reference to FIG. 5, to releasably retain each end member 6 of the seat belt, lock mechanism 7 comprises a respective lock pin 36 substantially similar to lock pin 33 in FIG. 4.

Lock pin 36, however, is smaller in height than lock pin 33, so that, when release lever 8 is rotated, an annular projection 37 of lock pin 36 is moved axially by a plate 38 of lock mechanism 7, in opposition to the elastic action of a conical spring 39, to release relative end member 6 of the seat belt. That is, when release lever 8 is rotated as far as it will go, lock pin 36 frees the hole in end member 6, which is expelled from slot 5 by an ejector spring 40 loaded when inserting end member 6.

Operation of buckle 1 and additional component 20 will be clear from the foregoing description.

The advantages of the buckle according to the present invention will also be clear from the foregoing description.

In particular, in normal driving conditions, as opposed to contacting the release lever in the rest position, the driver's legs tend to rest on the convex surface of the lever guard portion, which thus prevents any inadvertent movement of the release lever and, hence, undesired release of the seat belt. Moreover, the buckle is compact and lightweight, which are essential characteristics in racing car applications, by only guarding the release lever in the rest position, i.e. only when necessary.

The particular ovoid shape of the buckle, with no projections, and the thickness of the lever guard portion, equal to that of the buckle, produce no discomfort when the buckle comes into contact with the driver's legs, and at the same time permit troublefree voluntary manual operation of the release lever.

Finally, the fact that the end of the release lever is positioned directly contacting the lever guard portion prevents accidental insertion of foreign bodies between the lever guard portion and the release lever.

Clearly, changes may be made to the buckle as described and illustrated herein without, however, departing from the scope of the present invention as defined in the accompanying Claims.

In particular, the lever guard portion may be shaped otherwise than as described and/or be formed in one piece with the buckle casing, with no need for the lock appendix or lock device.

The invention claimed is:

1. A seat belt buckle which comprises:

a casing defining at least one slot engageable by an end member of a seat belt for connection therewith, a lock mechanism housed in said casing for releasably retaining said end member and a release lever fitted to said casing and movable, from a rest position, along a path lying in an actuating plane to release said lock mechanism from said end member, said release lever comprising an end projecting from said casing in said actuating plane as the release lever moves along said path, wherein a lever guard portion is fitted to said casing and has a lateral surface, an ideal extension of said lateral surface being in a direction perpendicular to said actuating plane surrounding said end of said release lever in said rest position, said lever guard portion forming part of an additional safety component, separate from said casing and fixed to the casing, said casing comprising an outer surface defined by a circular generating line, said lever guard portion comprising a curved concave surface complementary to and contacting said outer surface.

2. The buckle as claimed in claim 1, wherein said lever guard portion forms one piece with said buckle casing.

3. The buckle as claimed in claim 1, wherein said lever guard portion forms part of an additional safety component separate from said casing and fixed to the casing.

4. The buckle as claimed in claim 1, wherein said release lever comprises a plate lying in said actuating plane and a grip appendix projecting from said plate in an opposite direction to said lever guard portion.

5. The buckle as claimed in claim 1, wherein said casing comprises a number of slots unequally spaced angularly about an axis perpendicular to said actuating plane, and which are engageable, respectively by said end members and said lock appendix.

6. The buckle as claimed in claim 4, wherein said plate comprises a circular ring hinged to a face of said casing to rotate about a hinge axis perpendicular to said actuating plane and an arm integral with said circular ring and comprising said end, said grip appendix being located at said end of said arm.

7. An additional safety component for a seat belt buckle as claimed in claim 1, the additional safety component comprising a lever guard portion for guarding one end of a release lever of said buckle and a lock appendix projecting from said lever guard portion and engaging a slot in said buckle.

8. A seat belt buckle which comprises:

a casing defining at least one slot engageable by an end member of a seat belt for connection therewith, a lock mechanism housed in said casing for releasably retaining said end member and a release lever fitted to said casing and movable, from a rest position, along a path lying in an actuating plane to release said lock mechanism from said end member, said release lever comprising an end projecting from said casing in said actuating plane as the release lever moves along said path, wherein a lever guard portion is fitted to said casing and has a lateral surface, an ideal extension of said lateral surface being in a direction perpendicular to said actuating plane surrounding said end of said release lever in said rest position, said lever guard portion contacting said release lever in a direction perpendicular to said actuating plane.

9. The buckle as claimed in claim 8, wherein said casing comprises a further slot, said additional safety component comprising a lock appendix projecting from said lever guard portion and engaging said further slot.

10. The buckle as claimed in claim 9, comprising irreversible locking means housed in said casing and cooperating with said lock appendix to fix said additional safety component to said casing.

11. A seat belt buckle which comprises:

a casing defining at least one slot engageable by an end member of a seat belt for connection therewith, a lock mechanism housed in said casing for releasably retaining said end member and a release lever fitted to said casing and movable, from a rest position, along a path lying in an actuating plane to release said lock mechanism from said end member, said release lever comprising an end projecting from said casing in said actuating plane as the release lever moves along said path, wherein a lever guard portion is fitted to said casing and has a lateral surface, an ideal extension of said lateral surface being in a direction perpendicular to said actuating plane surrounding said end of said release lever in said rest position, said lever guard portion having the same thickness as said casing in a direction perpendicular to said actuating plane.

12. A seat belt buckle which comprises:

a casing defining at least one slot engageable by an end member of a seat belt for connection therewith, a lock mechanism housed in said casing for releasably retaining said end member and a release lever fitted to said casing and movable, from a rest position, along a path lying in an actuating plane to release said lock mechanism from said end member, said release lever comprising an end projecting from said casing in said actuating plane as the release lever moves along said path, wherein a lever guard portion is fitted to said casing and has a lateral surface, an ideal extension of said lateral surface being in a direction perpendicular to said actuating plane surrounding said end of said release lever in said rest position, said casing comprising an outer surface defined by a circular generating line, said lateral surface of said lever guard portion blending seamlessly with said outer surface to impart a substantially ovoid lateral profile to said buckle.

* * * * *